US005226285A

United States Patent [19]

Dankowski

[11] Patent Number: 5,226,285

[45] Date of Patent: Jul. 13, 1993

[54] SELF-CLEANING HEAT EXCHANGER FAN ASSEMBLY AND CONTROLS

[75] Inventor: Gerhard Dankowski, Royce City, Tex.

[73] Assignee: Danhard, Inc., Dallas, Tex.

[21] Appl. No.: 817,303

[22] Filed: Jan. 6, 1992

Related U.S. Application Data

[63] Continuation-in-part of Ser. No. 451,936, Dec. 18, 1989, abandoned.

[51] Int. Cl.[5] ..... F25B 39/04; F25D 21/06; F28G 13/00; F28G 15/06

[52] U.S. Cl. ..... 62/184; 62/151; 62/303; 62/325; 165/97; 165/95

[58] Field of Search ..... 165/97, 151, 152, 95; 62/155, 140, 303, 156, 184, 325, 151

[56] References Cited

U.S. PATENT DOCUMENTS

| | | | |
|---|---|---|---|
| 1,571,127 | 1/1926 | Ljungstrom | 165/95 |
| 1,967,019 | 7/1934 | Buchanan | 62/303 |
| 2,037,857 | 4/1936 | Fox . | |
| 2,525,462 | 10/1950 | Shell | 62/303 |
| 3,058,317 | 10/1962 | Putnam | 62/155 |
| 3,273,352 | 9/1966 | McCready | 62/155 |
| 3,364,692 | 1/1968 | Reynolds | 62/184 |
| 3,385,077 | 5/1968 | Marsteller | 62/180 |
| 3,453,837 | 7/1969 | Sandstrom et al. | 62/140 |
| 3,467,176 | 9/1969 | Truhan | 165/97 |
| 3,565,164 | 2/1971 | Kline et al. | 165/97 |
| 3,572,052 | 3/1971 | Toth | 62/155 |
| 3,638,445 | 2/1972 | Lavigne, Jr. | 62/184 |
| 3,645,330 | 2/1972 | Albright et al. | 165/151 |
| 4,066,119 | 1/1978 | Stedman | 165/97 |
| 4,076,072 | 2/1978 | Bentz | 165/95 |
| 4,086,779 | 5/1978 | Lewis | 62/180 |
| 4,122,892 | 10/1978 | Delaporte | 165/97 |
| 4,133,185 | 1/1979 | Dickey | 62/184 |
| 4,178,767 | 12/1979 | Shaw | 62/155 |
| 4,304,098 | 12/1981 | Rydahl | 62/186 |
| 4,510,991 | 4/1985 | Kawahira | 165/152 |

FOREIGN PATENT DOCUMENTS

| | | | |
|---|---|---|---|
| 1112094 | 8/1961 | Fed. Rep. of Germany | 165/97 |
| 0097852 | 8/1979 | Japan | 62/325 |
| 0086598 | 5/1986 | Japan | 165/97 |

*Primary Examiner*—John K. Ford
*Attorney, Agent, or Firm*—Richards, Medlock & Andrews

[57] ABSTRACT

A self-cleaning heat exchanger (10) has a reversible fan (12) located between two tube banks (14, 16) with a pressure switch (24) connected thereto. The fan (12) rotates in one direction blowing across the first tube bank (14) and drawing air over the second tube bank (16). The pressure switch and fan are interconnected by two relays (28, 30). When the refrigerant pressure in the tube banks exceeds the threshold pressure, the relay (28) is closed and grounded and electric current flows through the relay (30). The change in direction of current flow will reverse the polarity of the windings in motor (13) and thus the rotation of the motor (13) and the fan (12) thereby reversing air flow to remove debris from one tube bank while withdrawing heat from the other without loss of cooling efficiency.

6 Claims, 2 Drawing Sheets

SELF-CLEANING HEAT EXCHANGER FAN ASSEMBLY AND CONTROLS

CROSS REFERENCE TO RELATED APPLICATION

This application is a continuation-in-part of U.S. Application Ser. No. 07/451,936, filed Dec. 18, 1989 now abandoned.

TECHNICAL FIELD OF THE INVENTION

This invention relates to a self-cleaning heat exchanger having a fan for exhausting heat from a bank of heat exchange tubes such as condenser coils or the like.

BACKGROUND OF THE INVENTION

A variety of forced air heat exchangers exist that incorporate a fan, located proximate to fluid-carrying tubes, such as a condenser coil. The fan forces air across the tubes dissipating heat therefrom. Generally, these heat exchangers have a single bank of tubes with a fan located on one side thereof for blowing across the tubes in one direction. Heat exchangers of this type are utilized in a variety of environments including outdoors where the heat exchanger is exposed to dust, dirt, debris and weather. Heat exchangers of this type are utilized in the automotive industry, air conditioning, cryogenics and other moving as well as stationary uses. In many of these applications, debris can accumulate on the tube bank decreasing the efficiency of the heat exchanger. Also, heat exchangers of this type can encounter frost accumulation on the tube bank, also decreasing the efficiency thereof.

In order to clean or defrost the tube bank, various heat exchangers have used a reversible fan that forces the air across the tube bank in two directions; one direction for removing heat from the tube bank and an opposite direction for removing debris or frost therefrom. In these prior art units, the fan is rotated in its heat exchanging mode. As needed, the fan is then reversed to thaw frost from the heat exchange tubes or to remove debris from the tube bank. Until the debris is removed or the frost thawed, the unit is not providing optimum cooling. In effect, then, the heat exchanger is not operating at an acceptable efficiency for a period of time after cycling.

Therefore, a heat exchanger is needed that is self-cleaning without resulting in a period of a non-operativeness of the device.

SUMMARY OF THE INVENTION

The heat exchanger of the present invention utilizes tube banks located on opposites sides of a fan. The fan rotates in one direction blowing across the first tube bank and drawing air over the second tube bank, cooling it. As debris or other foreign matter collects on the second tube bank, controls cause the fan to reverse whereby air is then blown across the second tube bank. The reversal of air flow removes debris which has built up on the outward face of the second tube bank and acts to defrost ice which may have accumulated thereon. Cleaning of the tube bank is accomplished without any loss of heat exchange efficiency because the fan is removing heat from the heat exchange fluid flowing through the first tube bank.

BRIEF DESCRIPTION OF THE DRAWINGS

Further objectives and advantages of the invention will become more apparent from the following detailed description and claims, and from the accompanying drawings, wherein:

DETAILED DESCRIPTION

U.S. Application Ser. No. 07/451,936, filed Dec. 18, 1989, now abandoned, of which this application is a continuation-in-part, is incorporated herein by reference in its entirety.

Figure 1:
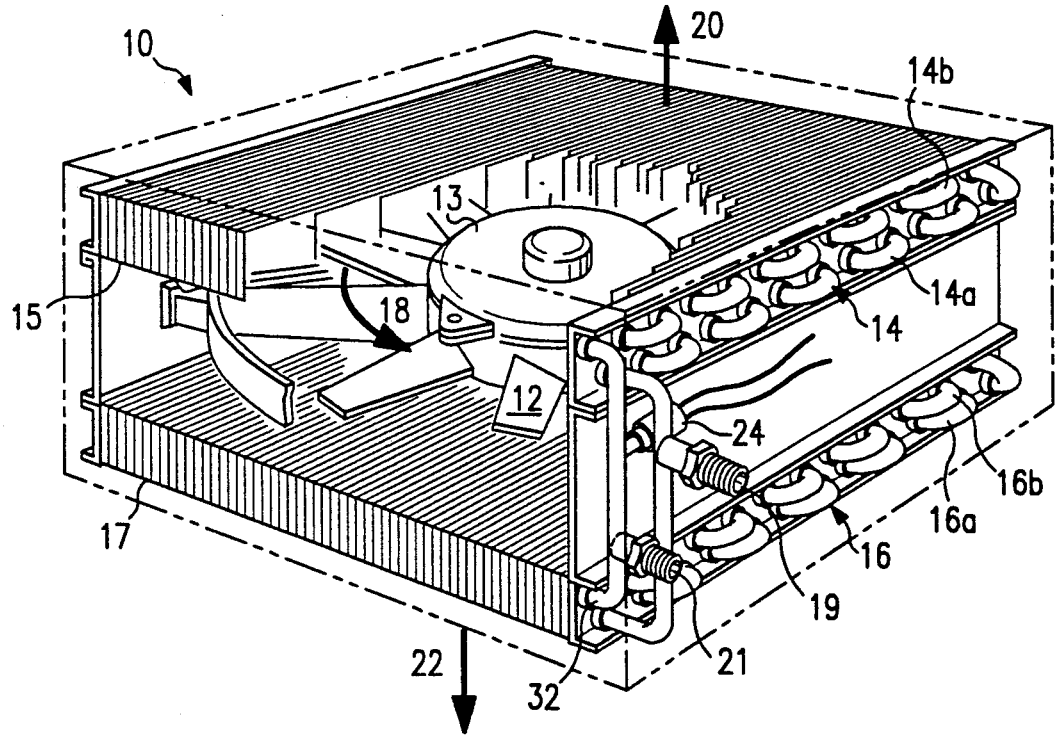
FIG. 1 is a perspective view of a dual condenser fan.

By way of example and description, the present invention is embodied as a dual condenser fan assembly 10. However, it will be understood that the present invention can be utilized in several other applications, for example, radiators, oil coolers, evaporators and for cooling fluids or gases. With reference now to the drawings, a dual condenser fan assembly 10 is shown in FIG. 1. Condenser fan assembly 10 consists of a pair of parallel heat exchange tube banks 14 and 16 with a reversible fan 12 positioned therebetween. Tube banks 14 and 16 consist of a fore and aft serpentine tubing sections 14*a*, 14*b* and 16*a*, 16*b*, respectively. Fan 12 is positioned such that air may be pushed or pulled across tube banks 14 or 16 depending on the rotational direction of the fan. Fan 12 is driven by a motor 13 or other direct or indirect power source. The method or means for driving the fan is inconsequential as long as provision is made to provide for selective reversal of the rotational direction of fan 12.

Figure 2:
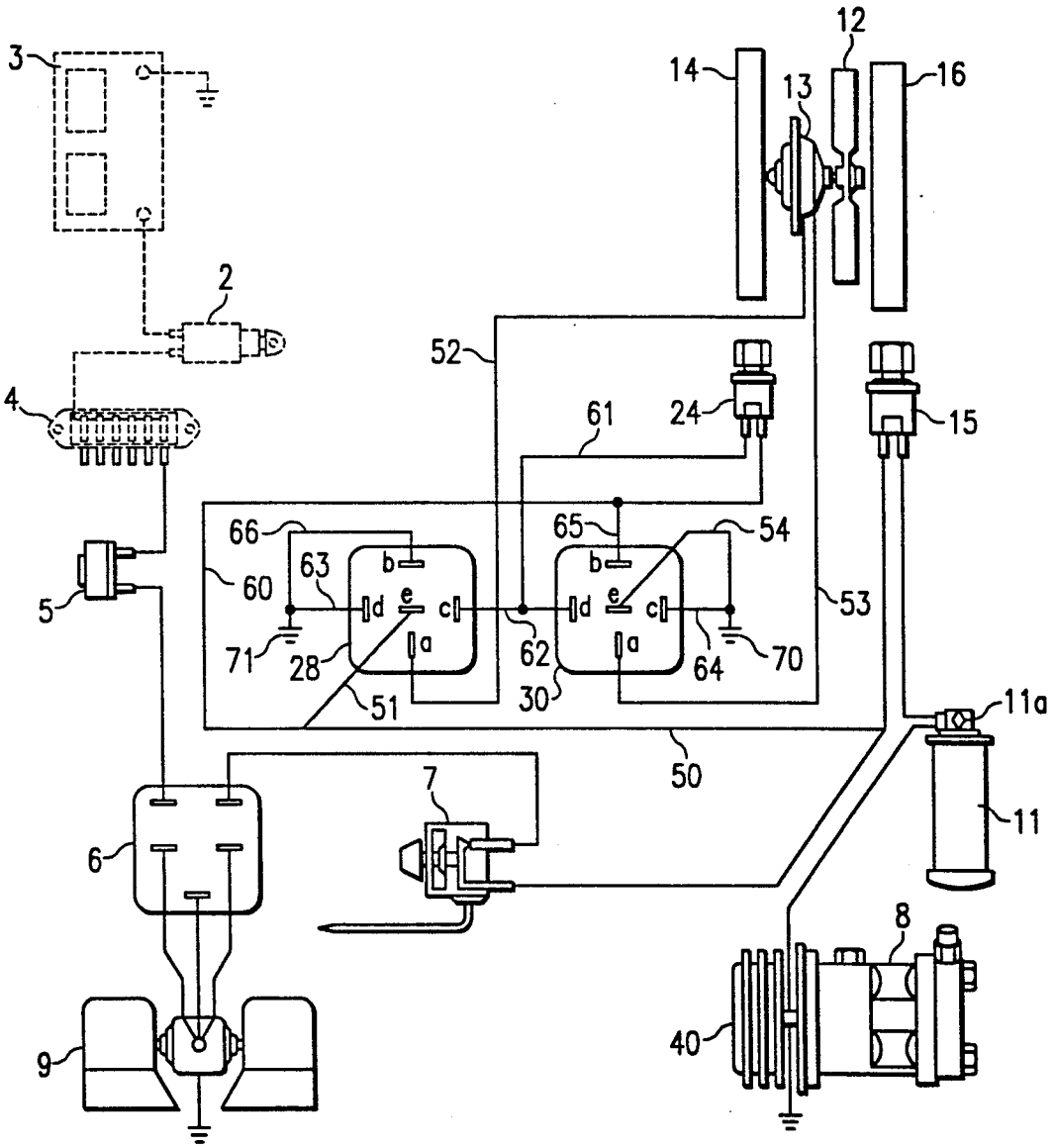
FIG. 2 is a wiring diagram for the dual condenser fan shown in FIG. 1.

Referring to FIG. 2, in one embodiment operation is initiated through ignition 2 and battery 3. Current is controlled through fuse box 4 and an amp breaker 5 to blower switch 6. Also incorporated in the overall assembly are thermostat 7, compressor 8 having a clutch 40, evaporator blower 9, receiver dryer 11, low pressure switch 11*a* and high pressure switch 15. These pressure switches are safety mechanisms for controlling the compressor 8 and clutch 40, as is well known in the art.

Heat transferring fluid enters the tubing sections 14*a* and 16*a* through inlet 19 and exits tubing sections 14*b* and 16*b* through outlet 21. When fan 12 turns in the direction of arrow 18, air is blown through tube bank 14 while air is pulled across tube bank 16, as shown by arrow 20. Turning fan 12 in the direction of arrow 18 dissipates heat from tube bank 16 while cleaning tube bank 14. By reversing fan 12, air is blown in the direction of arrow 22 thereby withdrawing heat from tube bank 14 while cleaning tube bank 16. Heat exchange from one tube bank and cleaning of the other tube bank is accomplished at the same time by reversing the rotation of fan 12. Thus, there is no time during operation when there is low heat exchange effectiveness. Specifically, as debris or thawing is being accomplished as to one tube bank, the other tube bank is operating at full efficiency.

Automatic control of the rotation direction of fan 12 is accomplished with pressure switch 24 and relays 28 and 30. Pressure switch 24 is mounted on return line 32 to monitor the refrigerant pressure therein. Switch 24 may alternatively be a heat sensitive switch.

FIG. 2 discloses the wiring diagram of the control mechanism for fan 12. The direction of rotation of motor 13, which rotates fan 12, is controlled by pressure switch 24. Electrical current from battery 3 travels through ignition 2, fuse box 4, amp breaker 5, blower switch 6, thermostat 7, and finally through line 50. Pressure switch 24 is a conventional switch and is normally open. When the refrigerant pressure reaches a predetermined threshold pressure, pressure switch 24 closes to allow an electrical current to flow therethrough. Therefore, until a threshold pressure is reached, electrical current does not flow from line 60 through to line 61. While pressure switch 24 remains open, electrical current flows through lines 50, 51, relay 28, line 52, motor 13, line 53, relay 30 and through line 54 to ground 70. Relays 28 and 30 have a normally closed switch running from pins E to A. This allows the electrical current to flow from line 51 to 52 and from 53 to 54. With electrical current flowing from line 52 to line 53, motor 13 rotates in a first direction.

When the refrigerant pressure reaches the predetermined threshold pressure, pressure switch 24 closes which allows electrical current to flow from line 60 through pressure switch 24 to line 61. Electrical current then flows to line 62 and to pins C and D of relays 28 and 30, respectively. Relays 28 and 30 have a solenoid coil connected from pin D to pin C. Electrical current will flow through the coils which will open the normally closed contacts connected from pins E to pins A. Relays 28 and 30 also have a normally open contact connected from pins B to pins A which is closed when current flows through the coils. Because the normally open contacts from pin B to pin A in relay 30 are closed when current flows from pin D to pin C through the solenoid coil, electrical current from line 60 can now flow through line 65 through pin B, through the now closed contacts to pin A and through line 53 to motor 13 to line 52, and through the closed contacts between A and B of relay 28 to ground 71 via line 66. Thus, with the use of these relays, the electrical current through motor 13 is reversed when the threshold pressure is reached. Heat will now be effectively removed because heat transfer will occur on the tube bank that has just been cleaned. The overall pressure will drop upon reversal of fan rotation because heat is now being effectively removed from the cleaned tube banks. The fan continues in the new direction until the threshold pressure is again reached which will open pressure switch 24. When pressure switch 24 opens, current to the coils connected from pins C to pins D will be interrupted, and normally closed contacts connected from pins E to pins A of relays 28 and 30 will close, thereby allowing electrical current to then flow from line 51 to line 52, through motor 13, through line 53, and finally through line 54 to ground 70. Each time the threshold pressure is reached, pressure switch 24 will change its position thereby reversing air flow from fan 12. Typically, threshold pressure is set at approximately 350 psi.

Alternatively, two or more switches may be utilized so that the device may operate such that once the threshold pressure is reached in one tube bank, the fan will reverse and rotate in that same direction until the threshold pressure is reached in the other tube bank; reversing the fan again and so on as required.

The pressure increase is caused by dust and other debris collecting on the surface of the tube banks 14 and 16. Pressure switch 24 is connected to the return line 32 for detecting the overall pressure increase or decrease within the tube banks 14 and 16. Pressure in the tube banks 14 and 16 varies depending on the heat exchange associated with each. If debris is located on tube bank 14 or 16, heat cannot be withdrawn from it. The fluid in the tube bank will not lose heat and the fluid will expand causing an increase in pressure that will be detected by pressure switch 24. This, in turn, controls relays 28 and 30.

In one embodiment, tube banks 14 and 16 are surrounded by heat exchanger fins such as fins 15 and 17. Alternatively, the tube banks may be enclosed by a mesh screen to prevent debris from accumulating on the tube banks themselves. In either configuration, the debris will collect on the fin tips or be collected on the screen forming a layer of dust and debris across the surface thereof as shown in FIG. 2 by layer 38. As outlined above, however, reversal of the fan 12 will dislodge layer 38 and allow heat to be withdrawn from the tube banks 14 and 16 as air is circulated through them.

It will be understood that the dual condenser fan assembly 10 is just one embodiment in which the present invention may be utilized. The present invention may also be utilized in conjunction with radiators or oil coolers by using heat sensing devices rather than pressure switches. The present invention may also be utilized in a dual evaporator configuration with a reversible fan sandwiched between two evaporator coils, with the fan direction controlled by low pressure switches. When an evaporator coil freezes up, the fan motor reverses, allowing the frozen coil time to defrost without shutting the device down. In a similar fashion, to that of the condenser embodiment, the present invention may be utilized in cryogenic applications.

While several embodiments of the present invention have been described in the foregoing detailed description, and illustrated in the accompanying drawings, it will be understood that the invention is not limited to the embodiments disclosed, but is capable of numerous rearrangements, modifications and substitutions of parts and elements without departing from the scope and spirit of the invention.

I claim:

1. An air conditioning system comprising:

a pair of condensers of a refrigeration system each comprising a plurality of tubes having heat exchanger fins attached thereto on which debris and other contaminates may collect, such tubes being positioned in substantially parallel planes to define tube banks which are likewise positioned in spaced, substantially parallel planes one to the other, such condenser tubes receiving refrigerant fluid for condensing such fluid;

a reversible fan located between said tube banks for forcing air in forward and reverse directions, both substantially perpendicular to the plane of the tube banks;

a pressure sensitive switch connected to said condenser tubes to measure pressure therein; and a controller interconnecting said pressure sensitive switch and said fan for controlling the direction of rotation of said fan in response to the pressure in said condenser tubes, said controller causing said fan to reverse direction when the pressure in the said condenser tubes exceeds a predetermined threshold level and thereby remove debris which has collected on the tube banks or heat exchanger fins.

2. The air conditioning system of claim 1 wherein said controller for controlling the direction of said fan comprises a first and second relay connected to said pressure switch.

3. An air conditioning system comprising:

a pair of condensers of a refrigeration system each comprising a plurality of tubes positioned to form a two tube banks which are in spaced, substantially parallel planes one to the other, such tube banks defining outwardly facing faces on which debris and other contaminants can collect, said condenser tubes receiving refrigerant fluid for condensing such fluid;

a reversible fan located between said tube banks for forcing air in a forward and reverse direction, both substantially perpendicular to the plane of the outwardly facing faces of said tube banks;

a pressure sensitive switch connected to said condenser tubes to measure pressure therein; and a controller interconnecting said pressure sensitive switch and said fan for controlling the direction of rotation of said fan in response to the pressure in said condenser tubes, said controller causing said fan to reverse direction when the pressure in the said condenser tubes exceeds a predetermined threshold level and thereby remove debris which has collected on the outwardly facing face of said tube banks.

4. The air conditioning system of claim 3 wherein said controller for controlling the direction of said fan comprises a first and second relay connected to said pressure switch.

5. An air conditioning system comprising:

a pair of condensers of a refrigeration system comprising a plurality of tubes positioned to form two tube banks having a dimension in the direction of the air flow less than any dimension perpendicular thereto and having outwardly facing faces on which debris and other contaminant may collect, such faces being in spaced, substantially parallel planes one to the other, a reversible fan located between said tube banks for forcing air in forward and reverse directions, both substantially perpendicular to the plane of the outwardly facing faces of said tube banks, and the outwardly facing faces of the tube banks having an area greater than the area of the fan wherein the projection of the fan onto the tube bank does not extend beyond the perimeter of the outwardly facing faces of the tube banks;

a pressure sensitive switch connected to said refrigeration system condenser tubes to measure pressure therein; and a controller interconnecting said pressure sensitive switch and said fan for controlling the direction of rotation of said fan in response to the pressure in said tubes, said controller causing said fan to reverse direction when the pressure in the said refrigeration system condenser tubes exceeds a predetermined threshold level and thereby remove debris which has collected on the outwardly facing face of said tube banks.

6. The air conditioning system of claim 5 wherein said controller for controlling the direction of said fan comprises a first and second relay connected to said pressure switch.

* * * * *